United States Patent [19]

King et al.

[11] Patent Number: 4,526,301

[45] Date of Patent: Jul. 2, 1985

[54] SECURITY SYSTEM FOR STORAGE TANKS

[76] Inventors: Clifford D. King; Trudy L. Pierce, both of 4022-A Coronado, Oklahoma City, Okla. 73122

[21] Appl. No.: 430,359

[22] Filed: Sep. 30, 1982

[51] Int. Cl.[3] ..... B67D 5/32

[52] U.S. Cl. ..... 222/153; 137/383; 137/385; 251/94

[58] Field of Search ..... 251/249.5, 94; 137/315, 137/382, 385, 382.5, 383; 222/1, 153, 505; 70/DIG. 58, DIG. 63

[56] References Cited

U.S. PATENT DOCUMENTS

| | | | |
|---|---|---|---|
| 550,711 | 12/1895 | Eads | 137/385 |
| 1,251,806 | 1/1918 | Miller | 137/382 |
| 1,307,194 | 6/1919 | Follick | 137/382 |
| 1,947,081 | 2/1934 | Grady et al. | 70/DIG. 58 |
| 2,000,246 | 5/1935 | Neely | 137/315 |
| 2,059,085 | 10/1936 | Buck | 137/385 |
| 3,459,345 | 8/1969 | Chernak et al. | 222/505 |
| 4,345,617 | 8/1982 | Bravo | 137/385 |

*Primary Examiner*—H. Grant Skaggs

*Attorney, Agent, or Firm*—William R. Laney

[57] ABSTRACT

A security system for preventing theft of the liquid contents of storage tanks, such as those used for storing crude oil. The security system includes a first selectively locked access way, a second locked access way and a discharge valve security control subassembly accessible from outside the tank only by way of both access ways when both are unlocked. The discharge valve control subassembly is operatively associated with a housed, inaccessible discharge valve which can be opened only when the discharge valve security control subassembly is actuated. The discharge valve controls flow of the tank contents from inside to outside the tank through a discharge pipe.

20 Claims, 12 Drawing Figures

SECURITY SYSTEM FOR STORAGE TANKS

BACKGROUND OF THE INVENTION

1. Field of the Invention

This invention relates to security systems for preventing, or rendering very difficult, unauthorized access to the stored liquid contents of a liquid storage tank.

2. Background of the Invention

With the trend toward depletion of liquid fossil fuel resources, the value of crude oil has substantially increased. Such, indeed, is the present value of crude oil as it is produced at the lease and there stored pending removal to a refinery or other remote facility, that larceny of the contents of these storage tanks is rife.

Generally, lease located storage tanks provided for the storage or custody of oil and distillate produced at the well head have sufficient capacity to impound a large volume of, for example, from 100 to 5,000 barrels of liquid hydrocarbon. Authorized removal of the tank contents has been accomplished by the use of a discharge pipe which extends from an internal lower portion of the tank horizontally outwardly to a valve at or near the outer end of the discharge pipe. Tank trucks or other transportation means can be coupled to the discharge pipe when the valve provided in the discharge pipe on the outside of the tank has been opened.

Before the increase in oil prices, relatively straightforward or simple locks on the valves apparently were adequate to prevent significant theft of the liquid contents of the tanks; or blind flanges, caps or other suitable closure devices were used and were sufficient to deter theft.

With the dramatic increase in the value of crude oil and distillate, the audacity of oil theives has proportionately increased and ingenious schemes for larceny of the oil have been devised. Moreover, the difficulty and expense of continuously and adequately surveilling the tanks have enabled the practice of more destructive methods of theft in which, for example, the discharge pipes are sawed off or destroyed above the valve closing them, or other equally destructive methods of obtaining access to the contents of the tank have been used by unauthorized personnel.

BRIEF DESCRIPTION OF THE PRESENT INVENTION

The present invention provides a high security, theft prevention system for use with liquid storage tanks, and particularly crude oil storage tanks, for preventing theft of the contents of the tank while permitting legitimate and authorized removal of the contents by proper personnel.

Broadly described, the security system of the invention comprises, in a preferred embodiment, a first selectively locked access way at one side of the tank, or an external tank-associated housing, and providing access, when unlocked, to a cavity or indented chamber in the side of the tank or a tank-associated housing. A second locked access way is positioned inwardly (in the cavity), or laterally from the first selectively locked access way, and can be opened only when the first selectively locked access way has been opened.

The second locked access way, when locked, prevents operative access to a discharge valve security control subassembly located inwardly with respect to the outside of the tank or a tank-associated housing. The valve security control subassembly is thus accessible only after opening both the first selectively locked access way and the second locked access way. The valve control subassembly is operatively associated with a housed, inaccessible flow control valve, which valve can be opened only when the valve control subassembly is actuated after access to the control subassembly has been attained. The flow control valve is interposed in a discharge pipe which extends from inside the liquid storage tank, and through the security system of the present invention. The valve thus controls liquid flow from inside the tank to the outside thereof.

In one embodiment of the invention, the second locked access way, the valve security control subassembly and the valve itself are all mounted upon a slide plate located entirely within the outer circumference or confines of the tank (in the earlier described cavity) and are removable therefrom through a closure which is openable only from a location positioned inwardly from the first selectively locked access way, and after this access way has been unlocked and opened to permit the unit to be removed. Removal of the unit is facilitated by providing quick disconnect couplings in the liquid discharge pipe, and a valve closure element between the quick disconnect coupling and the intake of the discharge pipe, which intake is located within and near the bottom of the tank.

The invention may also take other forms and arrangements which will be hereinafter described.

An important object of the invention is to provide a security system for storage tanks which enables the contents of the tank to be relatively quickly and easily removed therefrom by authorized personnel, but which prevents thieves from effecting such removal within a time period which is sufficiently short to prevent detection of the theft, and which cannot be accomplished by unauthorized personnel without the use of specialized tools and special secret knowledge normally possessed only by authorized personnel.

GENERAL DESCRIPTION OF THE DRAWINGS

FIG. 3 is a sectional view taken along line 3—3 of FIG. 2.

FIG. 6 is a front elevation view of another embodiment of a security system constructed in accordance with the invention and illustrating first and second selectively locked access ways disposed in cooperating relationship at one side of the security system.

DETAILED DESCRIPTION OF A PREFERRED EMBODIMENT OF THE INVENTION

Figure 1:
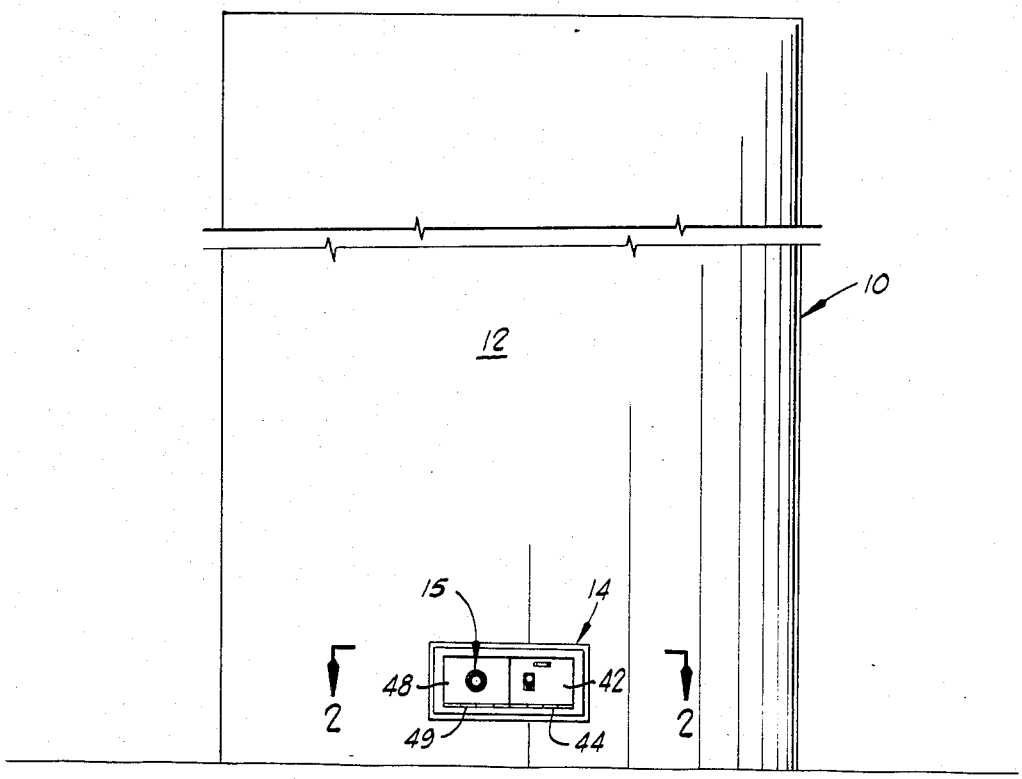
FIG. 1 is a side elevation view of a typical crude oil storage tank having one embodiment of the security system of the present invention mounted thereon.
Figure 5:
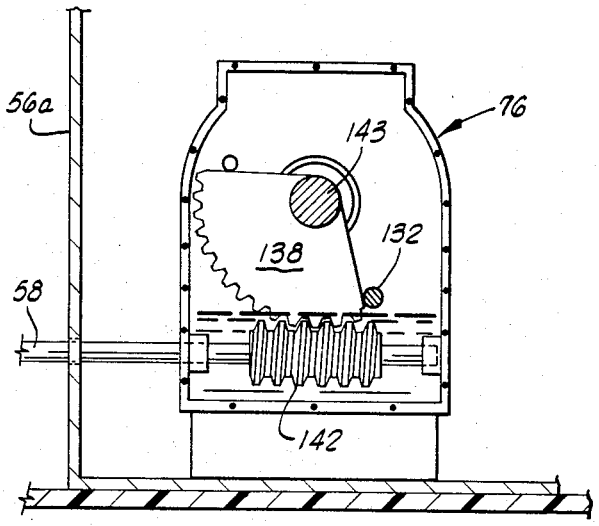
FIG. 5 is a sectional view taken along line 5—5 of FIG. 2.

Referring initially to FIG. 1 of the drawings, shown therein is an oil storage tank 10 of generally cylindrical configuration, and including a cylindrical side wall 12. Near the lower portion of the side wall 12 an opening 13 is provided for the purpose of receiving and mounting the security system of the present invention, designated generally by reference numeral 14. The tank is provided with a segmented discharge pipe, designated generally by reference numeral 15, to facilitate authorized removal of the liquid contents of the tank through the security system 14 as hereinafter described.

Figure 2:
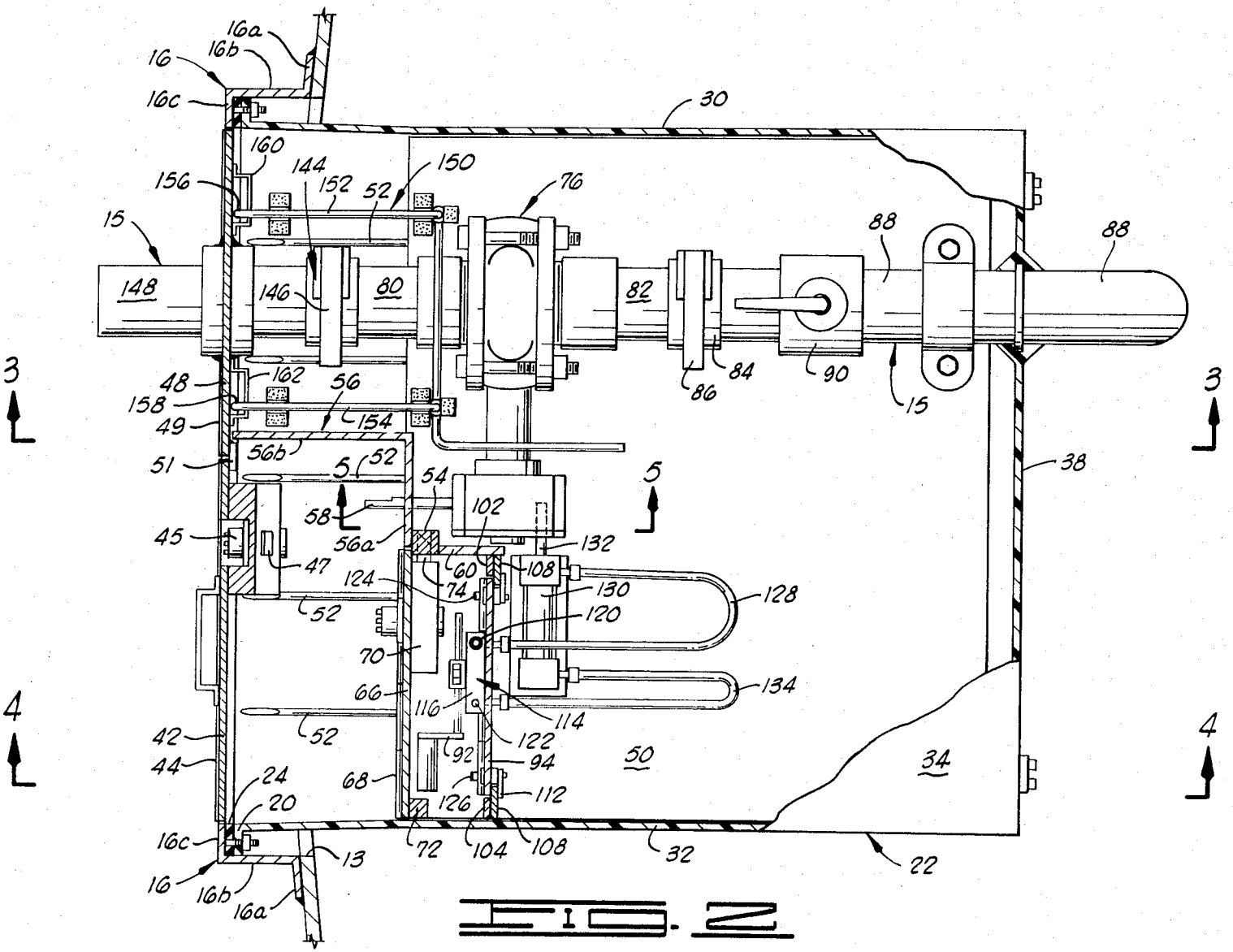
FIG. 2 is a sectional view taken along line 2—2 in a horizontal plane or section of the tank and through the top of the security system of the invention to illustrate details of construction of the security system.

The security system 14 of the invention can take several slightly variant forms, and can be placed at several locations relative to the tank 10 as will be hereinafter described. In the embodiment of the system shown in FIGS. 1-5, however, a mounting frame plate 16 of generally rectangular configuration in outline frames the opening in the wall 12 and includes a securement flange 16*a* which is welded to the tank wall 12 around the rectangular opening 13 into the tank as illustrated in FIG. 2. An offset web portion 16*b* which extends substantially normal to the flange 16*a* projects outwardly from the tank wall 12, and is connected at its outer edge to a facing flange 16*c*. The facing flange 16*c* extends normal to the web portion 16*b* and defines at its inner edge a rectangular opening.

The facing flange 16*c* serves as an anchoring and securement locus for a mating flange 20 formed around the outer end of a fiberglass housing or chamber, designated generally by reference numeral 22. The outer flange 20 of the fiberglass chamber 22 is secured by any suitable means, such as riveting or bolting, to the facing flange 16*c* and preferably bears against an elastomeric sealing element 24 interposed between the two flanges. The fiberglass housing 22 is a relatively rigid, high strength, molded structure in order to withstand a high hydrostatic head of liquid within the tank and to support an internal subassembly unit in a manner hereinafter described. At the rear end of the fiberglass housing 22, a pair of telescoping support legs 26 function to support the rear side of the fiberglass housing on the bottom of the tank inside the tank. Each of the support legs 26 includes a pair of relatively vertically movable elements 26*a* and 26*b* which are interconnected to each other by bolts, wing nuts or the like which are selectively positionable in a series of alignable holes in the two elements so that the overall length of each leg 26 can be adjusted according to the size and type of tank in which the security system of the invention is to be employed. Each of the legs 26 terminates at its lower end at a foot plate 28 secured thereto and adapted to rest flatly on the floor of the tank. The legs 26 can be adjusted as may be needed to maintain and support the fiberglass housing 22 in a substantially horizontal orientation within the tank.

In referring to FIGS. 2 and 3 of the drawings, it will be noted that the fiberglass housing 22 includes a pair of opposed side walls 30 and 32, a top wall 34, a bottom wall 36 and an inner or back wall 38. The side walls 30 and 32 and the top and bottom walls 34 and 36 terminate at their outer ends in the flange 20, hereinbefore described, and are integrally formed with each other and the flange. It will be noted in referring to FIGS. 2, 3 and 4 that the side and top walls of the housing 22 slightly flare divergently with respect to each other near the outer end of the housing where the walls join the flange 20. The purpose of this flaring or diverging relationship will be hereinafter explained.

The rectangular opening defined by the inner edge of the flange 16*c* forming a part of the mounting frame plate 16 is closed by two hinged doors. The first of these doors, hereinafter referred to as a first security door 42, closes a first access way and is hinged along one horizontal edge to the inner edge of a horizontal component of the facing flange 16*c* by a strong, protected hinge 44. The first security door is locked closed by means of a push-button type combination lock 45. The lock 45 is recessed into the door 42 to prevent access to it by a crow bar or other prying tool in order to break the lock or force entry through the door without using the proper combination to open the door.

Figures 4, 5:
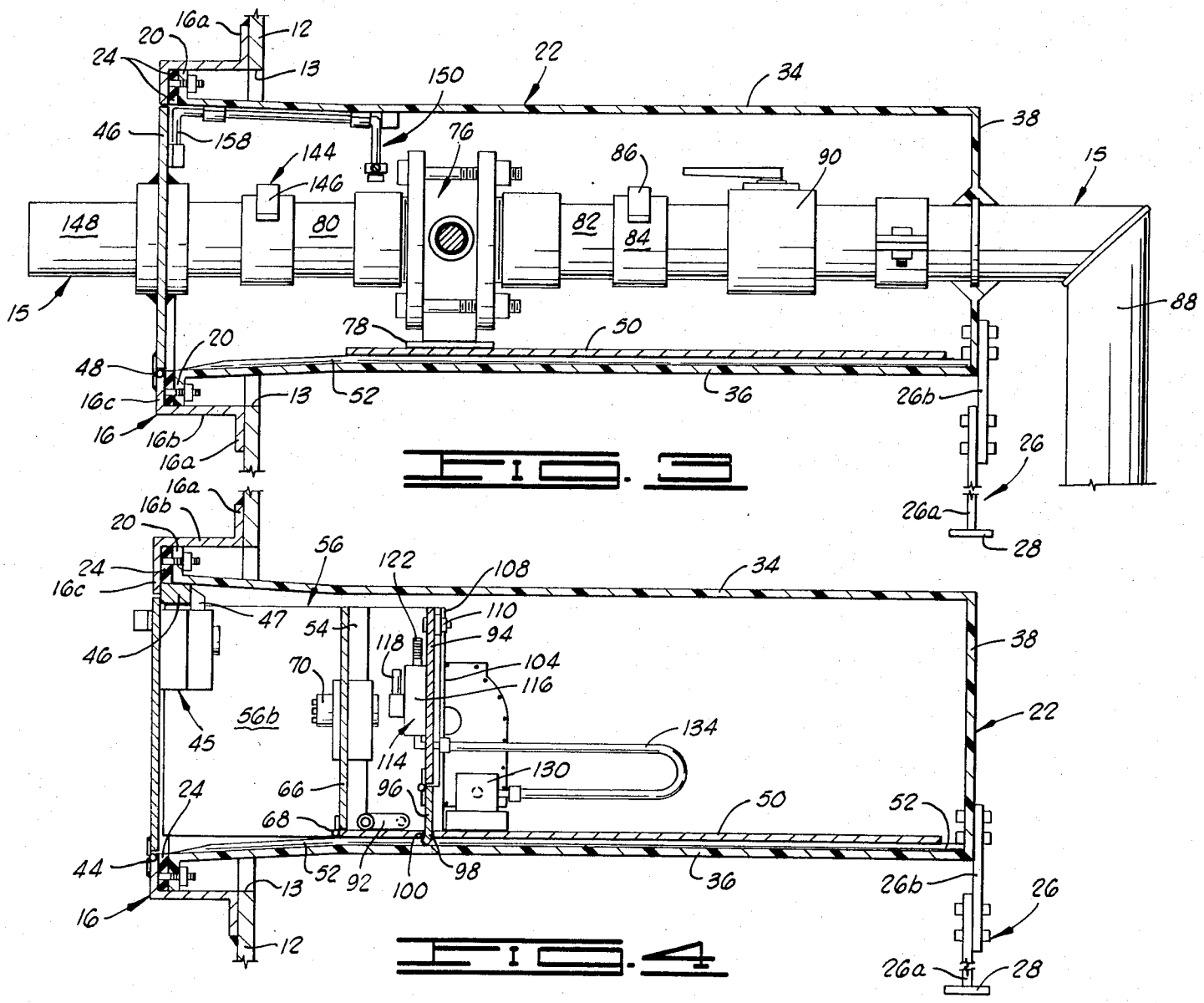
FIG. 4 is a sectional view taken along line 4—4 of FIG. 2.

The first security door 42 bears at its upper edge against a stop bar 46 which is secured on the inner side of the lower edge portion of the top, horizontally extending part of the facing flange 16*c* as shown in FIG. 4. The push-button type combination lock 45 includes a latching bolt 47 which, when extended to lock the first security door 42 engages behind the facing bar 46 as shown in FIG. 4.

The second of the two hinged doors which close the rectangular opening defined by the inner edge of the flange 16*c* is the door 48 which is to the left of the door 42 as the two are portrayed in FIG. 1 of the drawings. The second hinged door, hereinafter referred to as a mechanism access door, is hinged along its horizontally extending lower edge to the horizontal component of the facing flange 16*c* by a strong, protected hinge 49 similar to the protective hinge 44. The mechanism access door 48 will only be opened at a time when the first security door 42 is opened, and will be closed at all times that the first security door is closed (for reasons hereinafter explained). A stop flange 51 is welded to the inner side edge of the mechanism access door and bears against the inner side of the security door 42 as shown in FIG. 2. The mechanism access door 48 has a central opening therein to permit a section of the discharge pipe 15 to be extended therethrough in a manner and for reasons hereinafter described.

In order to permit certain parts of the security system 14 to be removed to a location outside the tank to facilitate maintenance and repair, a steel slide plate 50 is slidably mounted in the fiberglass housing 22 in an operative position upon a plurality of rigid slide runners 52 as illustrated in FIGS. 2, 3 and 4. The runners 52 are secured to the inner surface of the bottom wall 36 of the fiberglass housing 22. A post 54 is welded at its lower end to the slide plate 50, and has one vertical edge of a vertically extending right angle partition plate 56 welded thereto. The partition plate 56 has a section 56*a* which extends transversely in the fiberglass housing 22, and a section 56*b* which projects outwardly into proximity to the door 48 as illustrated in FIG. 2. The plate section 56*a* is apertured to permit a valve operating shaft 58 to extend therethrough. A vertical plate 60 also has a vertical edge secured to the post 54, and its lower edge secured to the slide plate 50.

Another hinged door, constituting a second security door, designated generally by reference numeral 66, has a horizontal lower edge which is connected by means of a hinge 68 to the forward edge of the slide plate 50 and is sized to fill substantially all of the space between the slide plate 50 and the top wall of the fiberglass housing 22. The second security door 66 has a push-button type combination lock 70 mounted thereon which is substantially identical to the push-button type combination lock 45 used on the first security door 42. At its opposite side edges, the door 66 bears against the post 54 and also against a second post 72 which is secured to and projects vertically upwardly from the slide plate 50 as shown in FIG. 2. The bolt 74 of the lock 70 engages a slot in the post 54.

Mounted upon the upper left side of the slide plate 50 (as it is viewed in FIG. 2) is a mechanically actuated gate valve, designated generally by reference numeral 76. The gate valve 76 is rigidly secured to and supported upon the slide plate 50 by a flanged supporting pedestal 78. The gate valve 76 is coupled between short sections 80 and 82 of the discharge pipe 15. A lever actuated quick disconnect coupling 84 which is operated by hand lever 86 is utilized for effecting quick connection and disconnection of the discharge pipe section 82 to a stationary portion 88 of the discharge pipe 15. The stationary portion 88 of the discharge pipe 15 contains a hand lever operated butterfly cut-off valve 90 located inside the fiberglass chamber 22. The stationary portion 88 of the discharge pipe 15 passes through a sealed opening in the back wall 38 of the chamber 22, and then is bent through a right angle so as to extend into proximity to the tank floor.

Lying upon the slide plate 50 immediately behind the second security door 66 is a crank handle 92 suitable for operating the manually actuated gate valve 76 by engagement with the valve operating shaft 58.

Spaced inwardly from the second security door 66 on the opposite side of the crank handle 92 is a vertically extending control panel plate 94 which is hinged along its horizontal lower edge to a base plate 96. The base plate 96 is secured by toes 98 inserted through slots 100 to the slide plate 50. The control panel plate 94, in the illustrated operative position, fits between, and is in coplanar alignment with, a pair of latching bars 102 and 104 which are secured at their lower ends to the slide plate 50. Latching bars 102 and 104 are welded to respective retainer flanges 106 and 108. Deadbolts 110 and 112 are extended and retracted by means of a pair of cylinder locks 124 and 126 carried on the control panel plate 94, and these deadbolts latch behind the retainer flanges 106 and 108 when the control panel plate is locked in the position illustrated in FIGS. 2 and 4.

Mounted upon that side of the control panel plate 94 which faces the second security door 66 is a three-way control valve, designated generally by reference numeral 114. The three-way control valve includes a housing 116, a valve operator handle 118, an air charging nipple 120 and an air discharge nipple 122, which nipples serve to convey air to and from the valving located interiorally of the housing 116. In the use of the three-way valve 114, compressed air from a suitable source, such as a portable tank, is connected by means of a suitable check valve, located in the end of a flexible conduit, to the air charging nipple 120 at a time when the valve operating handle 118 is pivoted to a valve-opening and charging position. At this time, compressed air can pass through the three-way valve into a charging conduit 128. The compressed air from the charging conduit 128 passes into the forward end of an air cylinder 130, and causes a spring extended piston rod 132 to be retracted by movement of a piston connected thereto and located within the cylinder 130. The purpose of this pneumatic actuation of the cylinder 130 to retract the piston rod 132 will be hereinafter explained.

So long as the valve operating handle 118 is pivoted to the valve-opening and charging position, compressed air can be charged through the conduit or tube 128 to the cylinder 130. When the handle is swung to a central, neutral position, the three-way valve is closed and the compressed air is retained within the conduit 128 and cylinder 130 to retain the piston rod 132 in a retracted position against the resilient bias of a spring (not shown) located in the cylinder. When the valve operating handle 118 is swung counterclockwise to an air discharge position, the compressed air is released or discharged through the discharge conduit or tubing 134, and is permitted to pass through the valve 114 and out the discharge nipple 122. This vents the cylinder 130 and permits the spring carried therein to act upon the internal piston to extend the piston rod 132 to the position illustrated in FIG. 2. This position of the piston rod 132 will be maintained even though the valve operating handle 118 is returned to the central or neutral position.

The function of the pneumatic control located on the control panel plate 94 and constituting the three-way valve 114 is to permit only authorized manual opening and closing of the manually actuated gate valve 76. This is accomplished by the mechanism shown in FIG. 5. Thus, when the piston rod 132 is extended, the gear segment 138 forming a part of the mechanically actuated gate valve 76 cannot be rotated by rotation of the manual actuation shaft 58, also forming a part of the manually actuated gate valve. When the piston rod 132 is retracted, however, this gear segment 138 can undergo rotation, which rotation is brought about by engaging the shaft 58 with the crank handle 92 after it has been retrieved following access attained thereto by the opening of the second security door 66. When the gear segment 138 undergoes rotation by driving engagement with the gear 142 on the shaft 58, the shaft 143 to which the gear segment 138 is keyed is rotated to open the gate valve 76. In this status, the liquid contents of the tank 10 can flow through the discharge pipe 15 to the outside of the tank for coupling to a suitable hose or other liquid discharge means for loading into a tank truck or direction to other points of disposition.

From the foregoing description it will be perceived that the gate valve 76 cannot be opened prior to the time that both of the first and second security doors 42 and 66 have been opened by the use of the push botton combination locks which secure these doors in a closed position. It is also necessary for the operator to have or be carrying a tank of compressed air with the knowledge that the final operation of the valve will be dependent upon retraction of the piston rod 132 so that the gate valve gear segment 138 can undergo rotation. Thus, the system is quite secure from clandestine opening of the gate valve 76 to permit the contents of the tank to be removed through the discharge pipe 15.

From time to time, it will be necessary or at least desirable to remove the working parts of the security system 14 of the present invention from the interior of the tank 10 to facilitate maintenance and repair. In order to permit this to be accomplished, the slide plate 50 can, under some circumstances, be removed from the interior of the tank by moving it out of the fiberglass housing 22 through the security door 42 and the second door 48 located at the front of the tank. In order to accomplish removal of the slide plate 50 and the structural elements carried thereon from the interior of the fiberglass housing 22, the combination lock 45 carried on the first security door 42 is first manipulated to retract the bolt 47, and thus permit the first security door to be pivoted downwardly about the pivotal axis defined by the pivot line of the hinge 44. It will be perceived in referring to FIG. 1 that this provides an opening across approximately one half of the total enlarged opening which is defined by the inner edge of the facing flange 16*c* carried on the mounting frame plate 16. Next, the second security door 66 is opened by pivoting it downwardly about the hinge 68.

When the second security door 66 has been opened in this manner, the cylinder locks 124 and 126 carried on the control panel plate 94 are actuated by the use of appropriate keys to retract the latching bolts 110 and 112 associated with the cylinder locks. With the release of the latch bolts 110 and 112 of the cylinder locks 124 and 126, the control panel plate 94 can be pivoted downwardly about the hinge to permit access to the open space behind and to the side of the control panel plate 94. Pivotation of the control panel plate 94 downwardly is facilitated by the hinge and by the flexibility of the air charging tube 128 and the air discharge tube 134.

When the control panel plate 94 has been pivoted forwardly and downwardly, as permitted by the opening downwardly of the second security door 66 as hereinbefore described, a person desiring to remove the security system 14 from inside the fiberglass housing 22 can do so by reaching around the vertical plate 60 to the location of a quick disconnect coupling 144 which is positioned in the discharge pipe 15. The quick disconnect coupling 144, which is manually engaged and disengaged by means of a pivoting handle 146, functions to couple a relatively short section 148 of the discharge pipe 15 to the short section 80 of the discharge pipe hereinbefore described. When the section 148 of the discharge pipe 15 is disconnected from the section 80 of the discharge pipe, the section 148 can then pivot downwardly with the door 48 at such time as this door is opened.

To facilitate opening of the door 48 by pivoting it downwardly about the hinge 49, a hand crank locking system, designated generally by reference numeral 150, is manually pivoted to retract locking bars 152 and 154, which carry locking toes 156 and 158, respectively, to an unlatching position. The locking toes, 156 and 158, when in their locking positions, pass downwardly into locking engagement with brackets 160 and 162 carried on the inner side of the door 48. With the lifting up of the locking bars 152 and 154 carrying the locking toes 156 and 158, the door 48 is free to pivot downwardly about the horizontal hinge 49 once the pipe section 148 has been disconnected from the discharge pipe section 80.

After the discharge pipe section 148 has been disconnected from the discharge pipe section 80 through release of the quick disconnect coupling 144, the next step in the removal of the operating elements of the security system is to disconnect the quick disconnect coupling 84 by use of the hand lever 86. When this disconnection is effected, the pipe section 82 is no longer connected to the stationary pipe section 88 and, if this latter pipe section is closed off by closure of the butterfly valve 90, the entire assembly carried upon the slide plate 50 can be slid out of the opening formed in the side of the tank when the door 48 is pivoted downwardly along with the first security door 42. These doors together, when opened, facilitate a large access opening to the interior of the fiberglass housing 22, and the flaring of the side walls 30 and 32, as well as the top and bottom walls 34 and 36, respectively, of this housing permit the slide plate 50 and the elements carried thereon to be easily slid forwardly and outwardly to remove them, in their entirety from the interior of the envelope 22. Thus, maintenance, repair or even replacement of the gate valve 76, the three-way valve 114 and the air cylinder 130 are facilitated in this fashion.

The embodiment of the security system of the invention which is illustrated in FIGS. 6–12 is intended to be mounted outside the liquid storage tank, and is adapted to have a first segment 170*a* of the discharge pipe 170 which extends from the lower portion of the storage tank connected into one side of the security system. A second segment 170*b* of the discharge pipe 172 projects from the other side of the security system.

The embodiment of the security system illustrated in FIGS. 6–12 includes a housing 174 of generally right parallelpiped configuration mounted upon a plurality of extensible supporting legs 176, 178, 180 and 182. Each of the extensible legs 176–182 includes an upper tubular portion 184 joined to the underside of the housing 174 through a securing plate 186, and a lower tubular portion 188 which telescopes into the upper tubular portion, and which carries a foot plate 190 at its lower end. The upper tubular portion and the lower tubular portion carry a series of a aligned apertures or holes 191. By adjustment of the relative position of the lower tubular portion, which telescopes in the upper tubular portion, and placement of a securing pin 192 through then aligned holes 191, the height of the housing 174 above the ground can be adjusted as may be needed for the particular height at which the discharge pipe 170 extends from the liquid storage tank.

Figure 8:
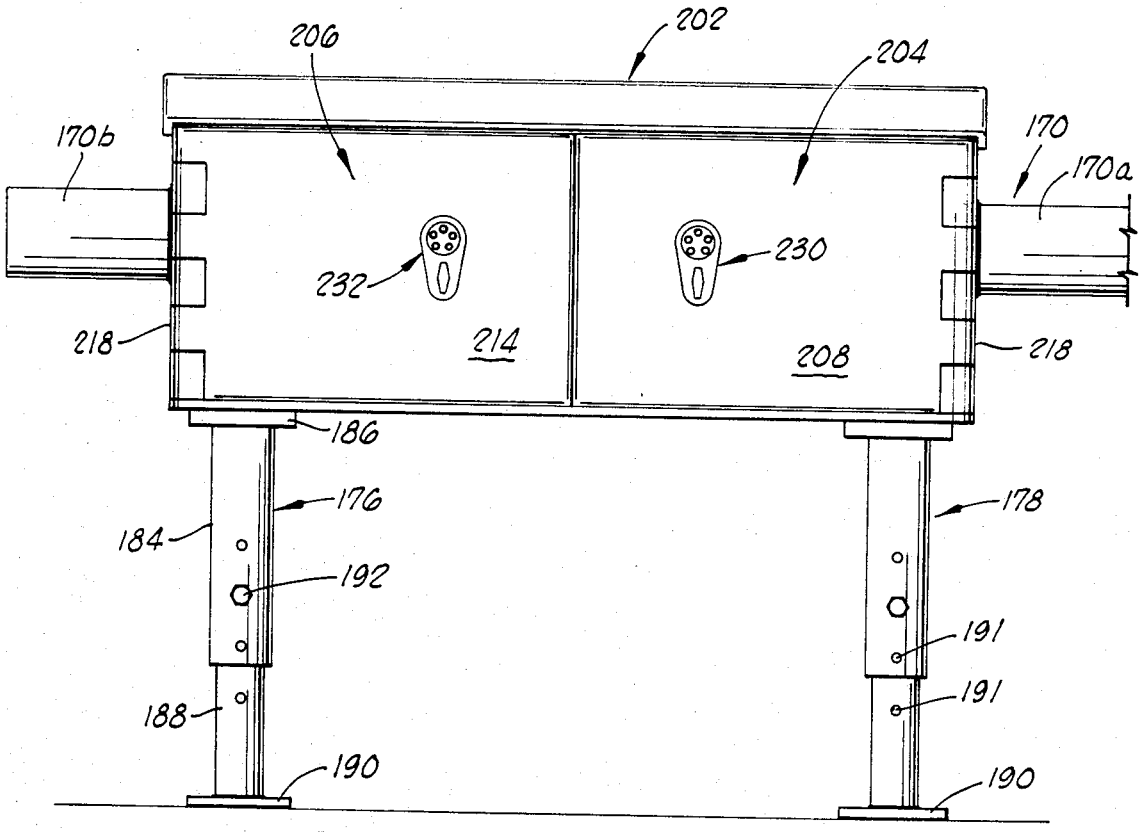
FIG. 8 is a sectional view taken along line 8—8 of FIG. 7.
Figure 8:
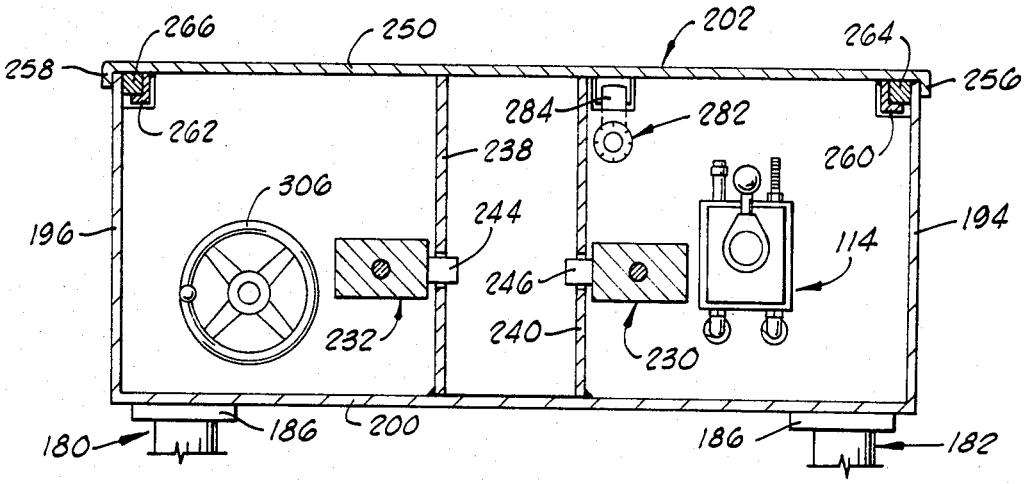
Figure 9:
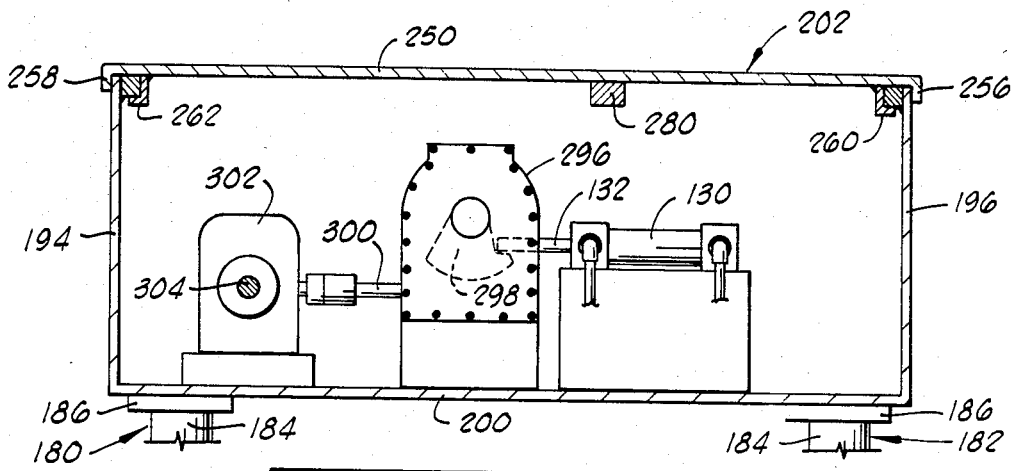
FIG. 9 is a sectional view taken along line 9—9 of FIG. 7.
Figure 10:
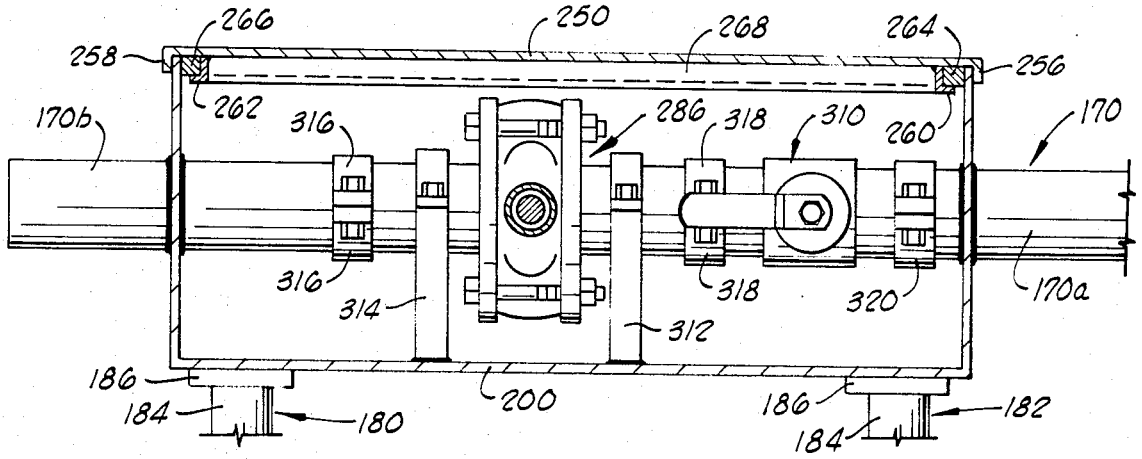
FIG. 10 is a sectional view taken along line 10—10 of FIG. 7.

As best illustrated in FIG. 8, the housing 174 includes a pair of opposed, parallel side walls 194 and 196 interconnected at their aligned rear edges by a back wall 198. The housing 174 further includes a bottom plate 200 and a removeable lid structure, designated generally by reference numeral 202 see FIGS. 6 and 8–12).

At the forward side of the housirg 174 are a pair of selectively-locked access ways designated generally by reference numerals 204 and 206. The selectively-locked access way 204 is closed by a door which includes a rectangular front plate 208 which is bent inwardly along one vertical inner edge to provide an inwardly directed flange 210 which is then bent through 90° to provide an abutment flange 212. In similar fashion, the access way 206 is closed by a door which includes a front plate 214 which has an inwardly directed flange 216 formed along one side edge thereof in closely registering abutting contact with the inwardly directed flange 210 of the plate 208 of the door of the access way 204. The front plates 208 and 214 of the doors of the two access ways 204 and 206 are cut out to provide projecting fingers 218 which interleave with cooperating projecting fingers carried on the side walls 196 and 194 and afford, in cooperation with hinge pins 222 and 224, a recessed hinge construction permitting the doors of the access ways to swing outwardly from the closed positions illustrated in FIGS. 7 and 8. At the lower edges of the two front plates 208 and 214, each of these plates is bent inwardly to form an inwardly extending horizontal flange, with these flanges denominated by reference numerals 226 and 228 as illustrated in FIG. 8, and extending inwardly into the housing immediately above the bottom plate 200. The door of access way 204 has a selectively settable combination lock system designated generally by reference numeral 230 mounted thereon for a purpose hereinafter described. In similar fashion, the door of access way 206 has a selectively settable combination lock system 232 mounted thereon. The locks 230 and 232 function similarly to that which has previously been described in referring to the embodiment of the invention shown in FIGS. 1-5, and designated by reference numeral 70 therein.

Spaced rearwardly within the housing 174 from the first and second access ways 204 and 206 is a transversely extending partition plate 234. The opposite ends of the partition 234 are secured by welding, or other suitable means, to the interior surface of the side walls 194 and 196 of the housing. Welded to a central portion of the partition plate 234 is a vertically projecting, rectangularly cross-sectioned locking post designated generally by reference numeral 236. The locking post 236 includes a pair of forwardly projecting vertical side walls 238 and 240 which are apertured at a location near a front wall 242 for the purpose of receiving the reciprocating bolts 244 and 246 of the locks 230 and 232, respectively. The front wall 242 of the locking post 236 provides a facing against which abutment flange 212 carried on the front plate 208 of the door of access way 204 abuts at a time when the access way is closed in the manner illustrated. It will be noted in referring to FIGS. 6 and 7 that the access way 206 must be opened before the second access way 204 can be opened. Opening of the access ways 204 and 206 is achieved by use of the selectively settable locks 230 and 232 into which a predetermined combination setting can be programmed at any time for security purposes. With the proper manipulation of these locks to procure retraction of the reciprocating bolts 244 and 246, the first access way 206 and then the second access way 204 can be opened to provide exposure to both ends of the transversely extending partition plate 234.

The lid structure 202 includes a flat, horizontally extending plate 250 which includes an overhanging downwardly angled flange 252 joined to its forward edge, and which is dimensioned to extend across the entire upper side of the housing 174. The flat horizontally extending plate 250 has peripheral, downwardly extending rim flanges 256 and 258 which project downwardly normal to the plane of the horizontally extending plate at the outer peripheral edges thereof, and bear flatly against the side walls 196 and 194.

Figure 7:
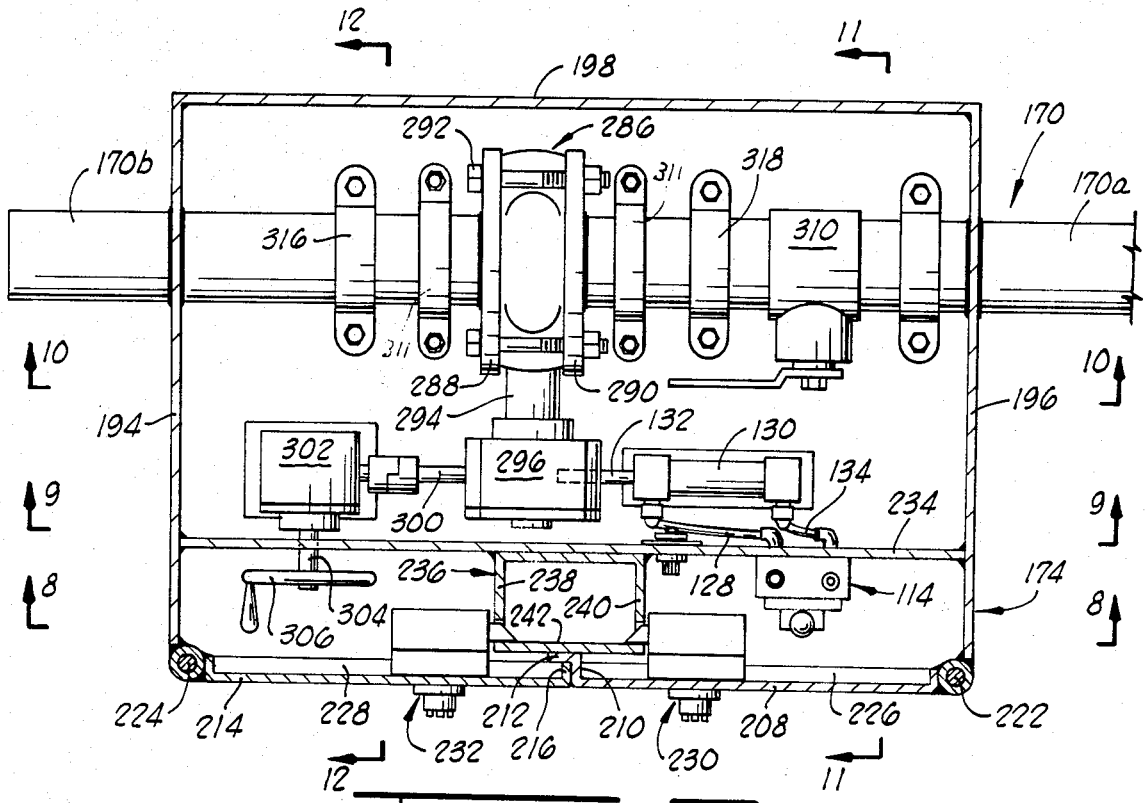
FIG. 7 is a sectional view taken along line 7—7 of FIG. 6.

Spaced inwardly from the rim flanges 256 and 258 at opposite side edges of the flat horizontally extending plate 250 are a pair of substantially parallel angle iron elements 260 and 262 (see FIG. 7). The angle iron elements 260 and 262 open outwardly toward the side walls 194 and 196. The angle iron elements are adapted to slideably engage a pair of retainer rails 264 and 266, respectively, which are welded or otherwise suitably secured to the inner faces of the side walls 194 and 196 adjacent the upper edges thereof. In similar fashion, an angle iron 268 is secured to the underside of the flat horizontally extending plate 250 near the rear edge thereof, and opens toward the back wall 198 of the housing 174. The angle iron 268 defines an open channel adapted to receive a retainer rail 270 which is welded or otherwise suitably secured to the inner side of the back wall 198 near the upper edge thereof. It will be noted in referring to FIG. 9 that the upper corners of the partition plate 234 are notched in order to accommodate the angle irons 260 and 262 and the rails 264 and 266 at the time when the lid structure 202 is secured in place on top of the housing 174 as illustrated in the drawings and as hereinafter described.

Near the front of the flat horizontally extending plate 250, and adjacent the overhanging flange 252, a downwardly extending front flange 272 having an inturned toe 274 is positioned so that the inturned toe 274 bears against inwardly turned flanges 276 and 278 carried at the upper edges of the door plates 208 and 214 of the respective access ways 204 and 206.

In order to lock the lid structure 202 in a position in which it is secured to and seals the top of the housing 174, the flat horizontally extending plate 250 has a lock abutment block 280 projecting downwardly from its underside. A combination lock 282 which includes a reciprocating bolt 284 is mounted on the partition plate 234 at a location to the right side of the locking post 236. In this position the lock 282 is accessible only after the second access way 204 has been opened. The lock 282 is positioned near the top of the partition plate 234 so that its bolt 284 is located to extend into a position adjacent the block 280 when the bolt is extended. As will be subsequently explained, this prevents removal of the lid structure 202.

A three-way control valve, designated generally by reference numeral 114, and thus identical in its construction to that which has been previously described in referring to the first embodiment herein, is mounted on the front facing side of the partition plate 234. The construction of the three-way control valve 114 has been previously described, and will not be here reiterated, the control valve including the same parts as those which have already been alluded to, which parts are assigned the same reference numerals. Further, as previously explained, the control valve 114 is connected through a charging conduit 128 and a discharge conduit 134 to an air cylinder 130 which contains a spring extended piston rod 132 which is actuated pneumatically as hereinbefore described.

A gate valve designated generally by reference numeral 286 is mounted in a section of the discharge pipe 170 by means of suitable flanges 288, 290 and bolts 292. An actuating shaft 294 projects from the gate valve 286 into a gear housing 296. The gear housing 296 contains a gear segment 298 similar to the gear segment 138 previously described in alluding to the first embodiment of the invention. The gear segment 298 is actuated by a gear (not shown) carried on the end of an actuating shaft 300 which is connected through a gear reducing system 302 to a shaft 304 which projects through the partition wall 234 and has a hand wheel 306 keyed thereto. The hand wheel 306 is accessible when the access way 206 is opened.

Figure 11:
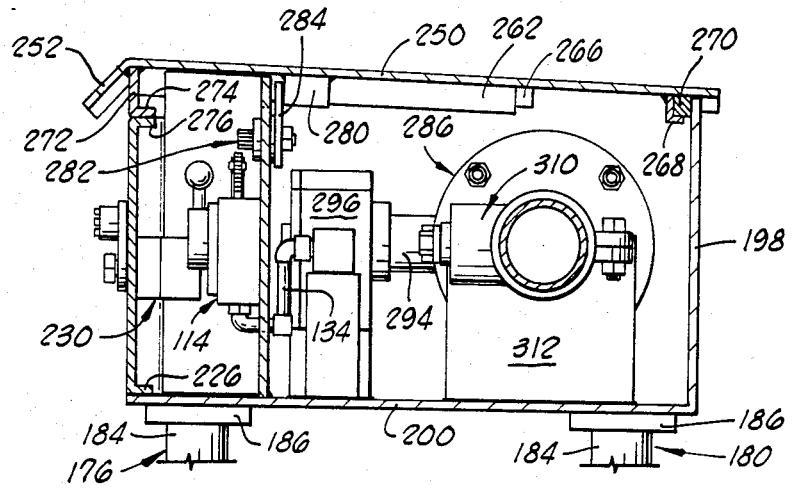
FIG. 11 is a sectional view taken along line 11—11 of FIG. 7.
Figure 12:
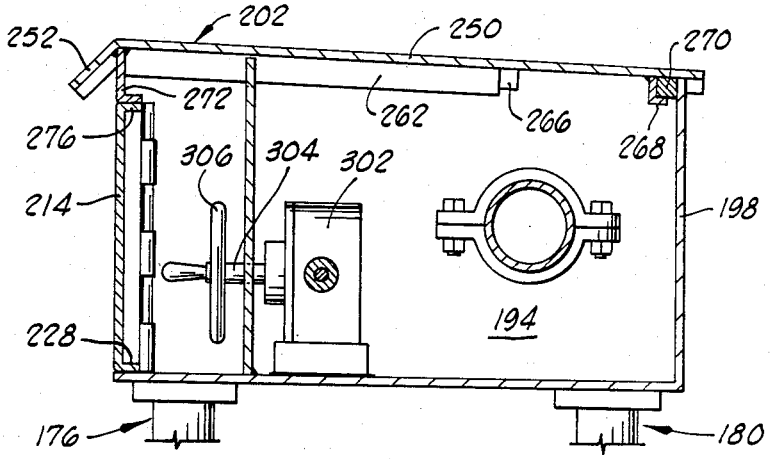
FIG. 12 is a sectional view taken along line 12—12 of FIG. 7.

As in the case of the embodiment shown in FIGS. 1-5, the portion of the discharge pipe 170 upstream from the gate valve 286 includes a hand lever operated butterfly cut-off valve 310, and the gate valve 286 is mounted in a short section of the discharge pipe and bolted by straps 311 to the tops of a pair vertically extending supporting stanchions 312 and 314 which project upwardly from the bottom plate 200 as shown in FIG. 11. Quick disconnect couplings 316 and 318 are also provided in the discharge pipe at the locations shown to facilitate maintenance and repair of the security system of the invention as hereinafter described.

In the use of the embodiment of the security system shown in FIGS. 6–12, the housing 174 is adjusted in its height so that the connection of the discharge pipe 170 can be effected at the level where the discharge pipe extends horizontally from the lower portion of the liquid storage tank. When the security system is in place and is in use, the housing 174 is locked and sealed as shown in FIG. 6. The lid structure 202 is locked atop the housing 174 at this time by initially having horizontally slid the housing into position so that the angle irons 260 and 262 hook under the retainer rails 264 and 266. The angle iron 268 is also engaged by the retainer rail 270 at the back wall 198 of the housing 174. With the lid structure 202 thus positioned, the lock 282 is actuated to extend the reciprocating bolt 284 to a position behind the lock abutment block 280. This prevents the lid structure 202 from being slid forwardly on the housing 174, or lifted upwardly on the housing, and thus prevents its removal from the housing.

It will also be noted in referring to FIG. 6 that at this time, the two access ways 204 and 206 have their doors in the closed position. The construction of the access way doors and the hinge structures by which they are hingedly mounted in the housing is such that it is difficult to place pry bars or the like in any location adjacent these access way doors to pry them open. When the access way doors are locked, the bolts of the selectively settable locks 230 and 232 are extended and project through the openings in the forwardly projecting side walls 238 and 240 of the locking post 236. It will be noted from the construction of the first and second access ways shown in FIG. 8 that even though the bolt of the lock 230 should be retracted to unlock the door of access way 204, this access way will still be retained in a locked status by reason of the relationship of the abutment flange 212 to the inwardly directed flanged 216 carried on the front plate 214 of the access way 204.

At a time when it is desired to transfer liquid from the liquid containing tank, the door of the access way 206 is opened, as hereinbefore described, by depresssing in proper sequence, the buttons on the selectively settable lock 232. When this has been accomplished, rotation of the lock cylinder can then be accomplished to retract the bolt of the lock 232 from the opening in the plate 238. The plate 214 forming the door of the first access way can then be pivoted about its hinge structure.

At this point it should be noted that even though the first access way 206 has been opened in the manner described, this affords access only to the hand wheel 306 by which the gate valve 286 is ultimately controlled, but it does not afford access to the three-way control valve 114. From the previous description of the embodiment shown in FIGS. 1–5, it will be appreciated that the function of the three-way control valve 114, and the associated air cylinder 130 and spring extended piston rod 132 is to lock the gear segment 298 against rotative movement, thus providing a positive mechanical interlock which prevents opening of the gate valve 286 by the use of the hand wheel 306.

To attain access to the three-way control valve 114, the door of the access way 204 must be opened and this, again, entails prior knowledge of the proper sequence and order of progression of manipulating the buttons on the selectively settable lock 230. When the proper button depression has been accomplished, the door of the access way 204 can be opened and, as will be perceived in referring to FIG. 8, access can then be had to the three-way control valve 114. This valve can then be manipulated with a compressed air cylinder as previously described to cause the spring extended piston rod 132 to be retracted. Further, the piston rod can be locked in the retracted position by manipulation of the handle of the three-way control valve 114.

When retraction of the piston rod 132 has been accomplished, the hand wheel 306 can then be rotated to cause the gear segment 298 to be rotated, and this movement, in turn causes the shaft to which this gear segment is keyed to undergo rotation, thus opening the gate valve 286 and permitting the liquid from the tank to flow through the discharge pipe 170. When the discharge of the amount of liquid desired has been completed, the hand wheel 306 is rotated in the opposite direction to close the gate valve 286. When the gate valve has been closed, the three-way control valve 114 is manipulated to bleed the air from the cylinder 130 and permit the spring included in this assembly to again bias or extend the piston rod 132 to the position illustrated in FIG. 10, in which position, it prevents rotation of the gear segment 298. Thus, the gate valve 286 is locked in the closed position. The door of the access way 204 is then closed and locked, causing the bolt of this lock to extend into the opening through the plate 240. Finally, the door of the other access way 206 is closed and locked in similar fashion.

In the event it is necessary or desirable to repair or replace the gate valve 286, this can be easily accomplished in the embodiment of the invention illustrated in FIGS. 6–12. Initially, the lid structure 202 is removed from the housing 174. In order to remove the lid structure 202, the doors of the two access ways 204 and 206 are opened in the manner hereinbefore described by proper manipulation of the locks 230 and 232. When the doors of the access ways are thus opened, the lock 282 becomes accessible and can be manipulated in accordance with correct foreknowledge of the combination of the lock to retract the bolt 284. With the retraction of the bolt 284, no obstruction or blocking element is interpositioned ajacent the abutment block 280 so as to prevent sliding movement of the lid structure 202 towards the forward side of the housing 174. By sliding the lid structure in this direction, the angle iron tracks 260 and 262 are guided upon the retainer rails 264 and 266.

After the lid structure 202 has been removed to completely open the top of the housing 174, access can be had from above to the gate valve 286. The gate valve 286 can be removed from the fluid discharge pipe simply by loosening the bolts which hold the straps 311 to the top of the vertically extending supporting stanchions 312 and 314, and then opening the quick-connect clamps 316 and 318. Prior to opening these clamps, however, the cut-off valve 310 is closed so as to prevent liquid from the tank from flowing through the opened discharge pipe.

When these operations have been accomplished, the gate valve 286 can be removed from the line to repair or replace it. When the gate valve has been repaired or replaced, the lid structure 202 is replaced on top of the housing in a manner involving steps reversed in sequence from those used to remove it from the housing, and the lock 282 is then manipulated to extend the bolt 284 into its locking position preventing unauthorized removal of the lid structure. The doors of the access ways 204 and 206 are then closed and locked. The system is now secured against unauthorized entry and manipulation of the gate valve 286 to permit the theft of liquid from the tank.

Although two preferred embodiments of the present invention have been herein described, and are depicted in the drawings, it will be understood that various changes and innovations in the illustrated and described structure can be effected without departure from the basic principles which underlie the invention. Changes in innovations of this type are therefore deemed to be circumscribed by the spirit and scope of the invention, except as the same may be necessarily limited by the appended claims or reasonable equivalents thereof.

What is claimed is:

1. A fluid storage tank security system comprising:
housing means;
a fluid discharge pipe extending through the housing means and adapted to discharge fluid from inside the tank;
valve means inside the housing means and positioned in the discharge pipe to control the flow of fluid through the discharge pipe;
a selectively locked access way at one side of said housing means providing access, when opened, to a chamber within said housing means; and
control means accessible only via said access way for selectively preventing manual opening of said valve means by unauthorized personnel, wherein said control means includes a pneumatic locking system for selectively locking and unlocking said valve means to facilitate subsequent opening or closing of said discharge pipe by use of said valve means.

2. A fluid storage tank security system as defined in claim 1 wherein said system further includes a fluid storage tank having said housing means recessed into one side of said tank.

3. A fluid storage tank security system as defined in claim 1 and further characterized as including a second selectively locked access way positioned in said housing means and preventing opening of said first-mentioned access way until said second access way is unlocked and opened.

4. A fluid storage tank security system as defined in claim 1 wherein said control means includes means for mechanically locking said valve means against opening and closing of said valve means to facilitate control of fluid flow therethrough.

5. A fluid storage tank security system as defined in claim 1 wherein said valve means includes:
a valve housing;
a gate element in said valve housing for opening and closing said discharge pipe;
a valve operating shaft connected to said gate element for opening and closing said gate element when said valve operating shaft is rotated; and
manual operator means in said housing means operatively engageable with said valve operating shaft for rotating said operating shaft after said control means is actuated to permit manual opening of said valve means.

6. A fluid storage tank security system as defined in claim 5 wherein said control means comprises another selectively locked access way preventing access, when closed, to said manual operation means.

7. A fluid storage tank security system as defined in claim 6 wherein said control means further comprises valve locking means within said housing means accessible through said first access way only after both access ways are opened, said valve locking means including structure preventing movement of said gate element until said valve locking means is actuated.

8. A fluid storage tank security system as defined in claim 7 and further characterized as including release means on said discharge pipe and within said housing for uncoupling a part of said discharge pipe in which said valve means is located from the remaining portion of the discharge pipe to thereby facilitate removal of the valve means from said housing.

9. A fluid storage tank security system as defined in claim 1 and further characterized as including:
means in said housing means having said valve means and at least a part of said control means attached thereto and sized to facilitate concurrent removal of said valve means and said part of said control means from said housing.

10. A fluid storage tank security system as defined in claim 1 and further characterized as including release means on said discharge pipe and within said housing means for uncoupling a part of said discharge pipe in which said valve means is located from the remaining portion of the discharge pipe to thereby facilitate removal of the valve means from said housing means.

11. A fluid storage tank security system as defined in claim 1 and further characterized as including:
mechanism access means in said housing means providing access, when displaced, to said valve means; and
locking means within said housing means locking said access means against opening from the outside, said locking means being accessible only via said first-mentioned selectively locked access way.

12. A system for storing and dispensing liquids comprising:
a liquid storage tank;
a discharge pipe extending from a location inside the tank to a location outside the tank;
a first valve in the discharge pipe for controlling liquid flow therethrough;
a second valve in the discharge pipe between the first valve and the end of the pipe inside the tank and functioning when closed, to terminate liquid flow through the pipe;
means forming a rigid security chamber surrounding said first and second valves and having said pipe extending therethrough from one side of the chamber to the other;
a mechanism access door positioned in one side of said chamber forming means and dimensioned to facilitate removal of said first valve therethrough;
internal latching means within said chamber forming means locking said mechanism access door against opening from the outside of said chamber;
releasing means located within said chamber forming means for releasing and disconnecting said first valve from said discharge pipe; and
a selectively locked access way in one side of said chamber forming means spaced from said mechanism access door and facilitating access to said first and second valves, releasing means and internal latching means to permit removal of said first valve from said chamber through said mechanism access door.

13. A fluid storage tank security system comprising:
housing means;
a fluid discharge pipe extending through the housing means and adapted to discharge fluid from inside the tank;

valve means inside the housing means and positioned in the discharge pipe to control the flow of fluid through the discharge pipe;

a selectively locked access way at one side of said housing means providing access, when opened, to a chamber within said housing means;

a second selectively locked access way positioned in said housing means and preventing opening of said first-mentioned access way until said second access way is unlocked and opened; and control means accessible only via said first-mentioned access way for selectively preventing manual opening of said valve means by unauthorized personnel, wherein said control means includes a fluid actuated locking system between said second access door and said valve means, said fluid actuated locking means including:

a piston rod extensible to a position within said valve means to prevent opening of said valve means;

a cylinder receiving said piston rod and operative, on the application of fluid pressure thereon, to retract said piston rod to a position facilitating opening of said valve means; and a fluid control valve connected to said cylinder and facilitating charging a fluid to said cylinder.

14. A fluid storage tank security system comprising:

housing means;

a fluid discharge pipe extending through the housing means and adapted to discharge fluid from inside the tank;

valve means inside the housing means and positioned in the discharge pipe to control the flow of fluid through the discharge pipe;

a selectively locked access way at one side of said housing means providing access, when opened, to a chamber within said housing means;

control means accessible only via said access way for selectively preventing manual opening of said valve means by unauthorized personnel; and means in said housing means having said valve means and at least a part of said control means attached thereto and sized to facilitate concurrent removal of said valve means and said part of said control means from said housing, wherein said means having said control means attached thereto comprises a slide plate slidably removable from said housing means.

15. A fluid storage tank security system as defined in claim 14 and further characterized as including:

a mechanism access door in said housing means providing access, when opened, to said valve means; and locking means within said housing locking said mechanism access door against opening from the outside, said locking means being accessible only via said first-mentioned selectively locked access way.

16. A fluid storage tank security system as defined in claim 14 wherein said control means includes a second selectively locked access way in said chamber providing access to said valve means.

17. A fluid storage tank security system as defined in claim 14 wherein said control means includes means for mechanically locking said valve means against opening and closing of said valve means to facilitate control of fluid flow therethrough.

18. A fluid storage tank security system as defined in claim 14 wherein said valve means includes:

a valve housing;

a gate element in said valve housing for opening and closing said discharge pipe;

a valve operating shaft connected to said gate element for opening and closing said gate element when said valve operating shaft is rotated; and a crank handle in said housing means operatively engagable with said valve operating shaft rotating said operating shaft after said control means is actuated to permit manual opening of said valve means.

19. A fluid storage tank security system comprising:

housing means;

a fluid discharge pipe extending through the housing means and adapted to discharge fluid from inside the tank;

valve means inside the housing means and positioned in the discharge pipe to control the flow of fluid through the discharge pipe;

a selectively locked access way at one side of said housing means providing access, when opened, to a chamber within said housing means;

a second selectively locked access way positioned in said housing means and preventing opening of said first-mentioned access way until said second access way is unlocked and opened, wherein said first-mentioned and second access ways are in side-by-side alignment at one side of said housing; and control means accessible only via said first-mentioned access way for selectively preventing manual opening of said valve means by unauthorized personnel.

20. A fluid storage tank security system comprising:

housing means;

a fluid discharge pipe extending through the housing means and adapted to discharge fluid from inside the tank;

valve means inside the housing means and positioned inside the discharge pipe to control the flow of fluid through he discharge pipe;

a selectively locked access way at one side of said housing means providing access, when opened, to a chamber within said housing means; and control means accessible only via said access way for selectively preventing manual opening of said valve means by unauthorized personnel, wherein said control means includes a fluid actuated locking system for selectively locking and unlocking said valve means to facilitate subsequent opening or closing of said discharge pipe by use of said valve means.

* * * * *